US011610712B2

(12) United States Patent
Taguchi et al.

(10) Patent No.: US 11,610,712 B2
(45) Date of Patent: Mar. 21, 2023

(54) INDUCTOR COMPONENT

(71) Applicant: Murata Manufacturing Co., Ltd., Kyoto (JP)

(72) Inventors: Yoshinori Taguchi, Nagaokakyo (JP); Yoshimasa Yoshioka, Nagaokakyo (JP); Akinori Hamada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 931 days.

(21) Appl. No.: 16/460,842

(22) Filed: Jul. 2, 2019

(65) Prior Publication Data

US 2020/0027638 A1 Jan. 23, 2020

(30) Foreign Application Priority Data

Jul. 17, 2018 (JP) ..... JP2018-134189

(51) Int. Cl.
*H01F 17/04* (2006.01)
*H01F 17/00* (2006.01)
(Continued)

(52) U.S. Cl.
CPC ..... *H01F 17/04* (2013.01); *H01F 17/0033* (2013.01); *H01F 27/255* (2013.01);
(Continued)

(58) Field of Classification Search
CPC .... H01F 17/04; H01F 17/0033; H01F 27/255; H01F 27/2823; H01F 27/292; H01F 27/234
See application file for complete search history.

(56) References Cited

U.S. PATENT DOCUMENTS 10,453,602 B2 10/2019 Yoshioka et al.
2010/0176909 A1* 7/2010 Yasuda ..... H01F 27/006 336/233
(Continued)

FOREIGN PATENT DOCUMENTS

CN 107818864 A 3/2018
JP 2003217935 A * 7/2003
(Continued)

OTHER PUBLICATIONS

An Office Action; "Notice of Reasons for Refusal," mailed by the Japanese Patent Office dated Feb. 9, 2021, which corresponds to Japanese Patent Application No. 2018-134189 and is related to U.S. Appl. No. 16/460,842 with English language translation.
(Continued)

*Primary Examiner* — Elvin G Enad
*Assistant Examiner* — Malcolm Barnes
(74) *Attorney, Agent, or Firm* — Studebaker & Brackett PC

(57) ABSTRACT

An inductor component comprising a magnetic layer containing a magnetic powder and a resin containing the magnetic powder, a first spiral wiring and a second spiral wiring disposed on the same plane in the magnetic layer and adjacent to each other, and an insulating layer disposed between the first spiral wiring and the second spiral wiring and containing no magnetic substance. The first spiral wiring includes a first side surface facing the second spiral wiring, and at least a portion of the first side surface is in contact with the magnetic layer.

19 Claims, 10 Drawing Sheets

(51) Int. Cl.

| | |
|---|---|
| ***H01F 27/28*** | (2006.01) |
| ***H01F 27/29*** | (2006.01) |
| ***H01F 27/25*** | (2006.01) |
| ***H01F 41/04*** | (2006.01) |
| ***H01F 27/255*** | (2006.01) |

(52) U.S. Cl.
CPC ..... *H01F 27/2823* (2013.01); *H01F 27/292* (2013.01); *H01F 41/046* (2013.01); *H01F 2017/0066* (2013.01); *H01F 2017/048* (2013.01)

(56) References Cited

U.S. PATENT DOCUMENTS

| | | | | |
|---|---|---|---|---|
| 2012/0019343 | A1* | 1/2012 | Hsieh | B65D 83/206 336/200 |
| 2013/0082575 | A1* | 4/2013 | Kang | H01G 4/008 336/200 |
| 2015/0048915 | A1* | 2/2015 | Yoon | H01F 17/0013 336/192 |
| 2015/0123757 | A1* | 5/2015 | Choi | H01F 41/046 29/609 |
| 2016/0172103 | A1* | 6/2016 | Jeong | H01F 27/292 29/605 |
| 2016/0217917 | A1* | 7/2016 | Jeong | H01F 27/292 |
| 2017/0196091 | A1* | 7/2017 | Lee | H01F 27/292 |
| 2017/0256353 | A1* | 9/2017 | Park | C23C 18/1653 |
| 2018/0277296 | A1* | 9/2018 | Endo | H01F 27/292 |
| 2019/0259527 | A1* | 8/2019 | Yoon | H01F 17/0033 |
| 2019/0362873 | A1* | 11/2019 | Arai | H01F 27/24 |

FOREIGN PATENT DOCUMENTS

| | | | |
|---|---|---|---|
| JP | 2010-027758 | A | 2/2010 |
| JP | 2013-225718 | A | 10/2013 |
| JP | 2018-046051 | A | 3/2018 |

OTHER PUBLICATIONS

An Office Action mailed by China National Intellectual Property Administration dated Jan. 5, 2022 which corresponds to Chinese Patent Application No. 201910628564.2 and is related to U.S. Appl. No. 16/460,842 with English language translation.

An Office Action; "Notice of Reasons for Refusal," mailed by the Japanese Patent Office dated Sep. 28, 2021, which corresponds to Japanese Patent Application No. 2018-134189 and is related to U.S. Appl. No. 16/460,842 with English translation.

* cited by examiner

INDUCTOR COMPONENT

CROSS REFERENCE TO RELATED APPLICATION

This application claims benefit of priority to Japanese Patent Application 2018-134189 filed Jul. 17, 2018, the entire content of which is incorporated herein by reference.

BACKGROUND

Technical Field

The present disclosure relates to an inductor component.

Background Art

A conventional inductor component is described in Japanese Laid-Open Patent Publication No. 2013-225718. This inductor component includes an insulating substrate, a spiral conductor formed on a principal surface of the insulating substrate, an insulating layer containing no magnetic powder covering the spiral conductor, and an upper magnetic layer and a lower magnetic layer covering the upper-surface side and the back-surface side of the insulating substrate and made of a resin containing a magnetic powder.

SUMMARY

In Japanese Laid-Open Patent Publication No. 2013-225718, since the insulating layer entirely covers the spiral conductor, a large region is occupied by the insulating layer with respect to the inductor component. The insulating layer contains no magnetic powder and has a lower magnetic permeability than the magnetic layers, which makes it difficult to improve an inductance. If a plurality of spiral conductors is disposed on the same plane, the region occupied by the insulating layer becomes larger, which makes it more difficult to improve the inductance. On the other hand, if the region occupied by the insulating layer is reduced to improve the inductance, the region occupied by the magnetic layers increases; however, the magnetic layers contain a magnetic powder and therefore provide lower insulation as compared to the insulating layer, which may cause deterioration in terms of voltage resistance and leak current.

Therefore, the present disclosure provides an inductor component in which ensuring of insulation and improvement in inductance can effectively be achieved.

Accordingly, an aspect of the present disclosure provides an inductor component comprising a magnetic layer containing a magnetic powder and a resin containing the magnetic powder, a first spiral wiring and a second spiral wiring disposed on the same plane in the magnetic layer and adjacent to each other, and an insulating layer disposed between the first spiral wiring and the second spiral wiring and containing no magnetic substance. The first spiral wiring includes a first side surface facing the second spiral wiring, and at least a portion of the first side surface is in contact with the magnetic layer.

According to the inductor component of the present disclosure, since at least a portion of the first side surface is in contact with the magnetic layer between the first spiral wiring and the second spiral wiring improved in insulation due to the insulating layer disposed therebetween, the region of the magnetic layer is increased, so that the inductance can effectively be improved while the insulation is ensured. The spiral wiring means a curve (two-dimensional curve) extending on a plane, may be a curve having the number of turns exceeding one or may be a curve having the number of turns less than one, or may have a portion that is a straight line.

In an embodiment of the inductor component, the insulating layer is disposed at a position including a region in which a distance is minimum between the first spiral wiring and the second spiral wiring. According to the embodiment, the insulation between the spiral wirings can further be improved.

In an embodiment of the inductor component, the insulating layer is in contact with a portion of the first side surface, and a second side surface on the side opposite to the first side surface of the first spiral wiring is in contact with the magnetic layer. According to the embodiment, the improvement of the inductance can more effectively be achieved.

In an embodiment of the inductor component, the magnetic layer is interposed between the insulating layer and the first side surface. According to the embodiment, the inductance can further be improved.

In an embodiment of the inductor component, the thickness of the insulating layer is larger than the thickness of the first spiral wiring. According to the embodiment, the insulation can further be improved.

In an embodiment of the inductor component, the inductor component further comprises a plurality of external terminals arranged on a surface of the magnetic layer, a first columnar wiring connecting the first spiral wiring and one of the plurality of external terminals and penetrating the magnetic layer, and a second columnar wiring connecting the second spiral wiring and one of the plurality of external terminals and penetrating the magnetic layer. The insulating layer is disposed also between the first columnar wiring and the second columnar wiring. According to the embodiment, the insulation can further be improved.

In an embodiment of the inductor component, the inductor component further comprises a third spiral wiring disposed above the first spiral wiring, and the first spiral wiring and the third spiral wiring are electrically connected. According to the embodiment, a degree of design freedom can be improved.

In an embodiment of the inductor component, the inductor component further comprises an interlayer insulating layer disposed between the first spiral wiring and the third spiral wiring, and the thickness of the interlayer insulating layer is smaller than the width of the insulating layer. According to the embodiment, both the insulation reliability and the height reduction can be achieved.

In an embodiment of the inductor component, the magnetic powder contains Fe-based magnetic powder. According to the embodiment, the DC superimposition characteristics can be improved.

In an embodiment of the inductor component, the Fe-based magnetic powder is FeSiCr and has an average particle diameter of 5 μm or less. According to the embodiment, the DC superimposition characteristics are improved, and an iron loss at high frequency can be reduced by fine powder.

In an embodiment of the inductor component, the resin contains at least one of an epoxy resin and an acrylic resin. According to the embodiment, the insulation among particles of the magnetic powder can be ensured, and an iron loss at high frequency can be made smaller.

In an embodiment of the inductor component, the magnetic powder contains ferrite powder. According to the embodiment, the effective magnetic permeability, i.e., the magnetic permeability per volume of the magnetic layer, can be improved by containing the ferrite having a high relative magnetic permeability.

In an embodiment of the inductor component, the insulating layer contains at least one of an epoxy resin, a polyimide resin, a phenol resin, and a vinyl ether resin. According to the embodiment, the insulation reliability can be improved.

In an embodiment of the inductor component, the first spiral wiring has an exposed portion exposed to the outside from a side surface parallel to a lamination direction of the inductor component. According to the embodiment, since the spiral wiring has the exposed portion, a resistance to electrostatic destruction can be improved at the time of manufacturing.

In an embodiment of the inductor component, a thickness of an exposed surface of the exposed portion is equal to or less than the thickness of the first spiral wiring and is 45 μm or more. According to the embodiment, since the thickness of the exposed surface is equal to or less than the thickness of the spiral wiring, the proportion of the magnetic layer can be increased, and the inductance can be improved. Additionally, since the thickness of the exposed surface is 45 μm or more, occurrence of disconnection can be reduced.

In an embodiment of the inductor component, the exposed surface is an oxide film. According to the embodiment, a short circuit can be suppressed between the inductor component and an adjacent component.

According to the inductor component of an aspect of the present disclosure, ensuring of insulation and improvement in inductance can effectively be achieved.

DETAILED DESCRIPTION

A surface-mount inductor of an aspect of the present disclosure will now be described in detail with reference to shown embodiments. The drawings include schematics and may not reflect actual dimensions or ratios.

First Embodiment (Configuration)

Figure 1A:
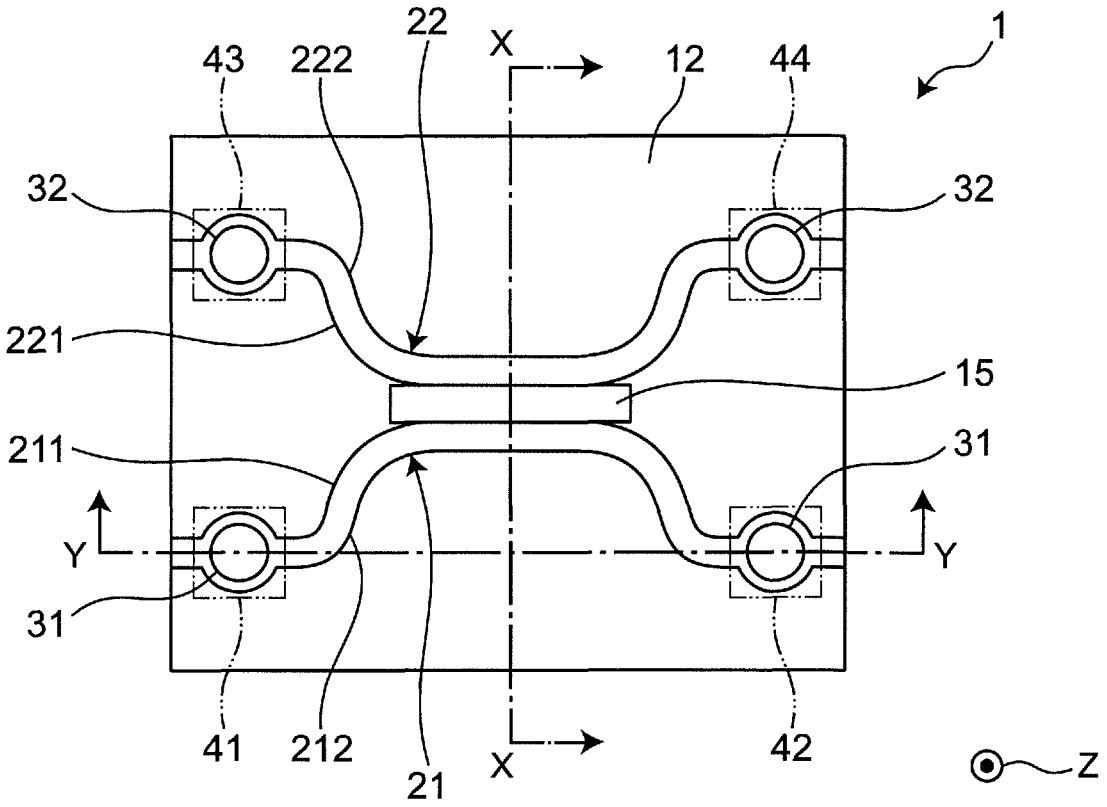
FIG. 1A is a transparent plan view showing an inductor component according to a first embodiment.
Figure 1B:
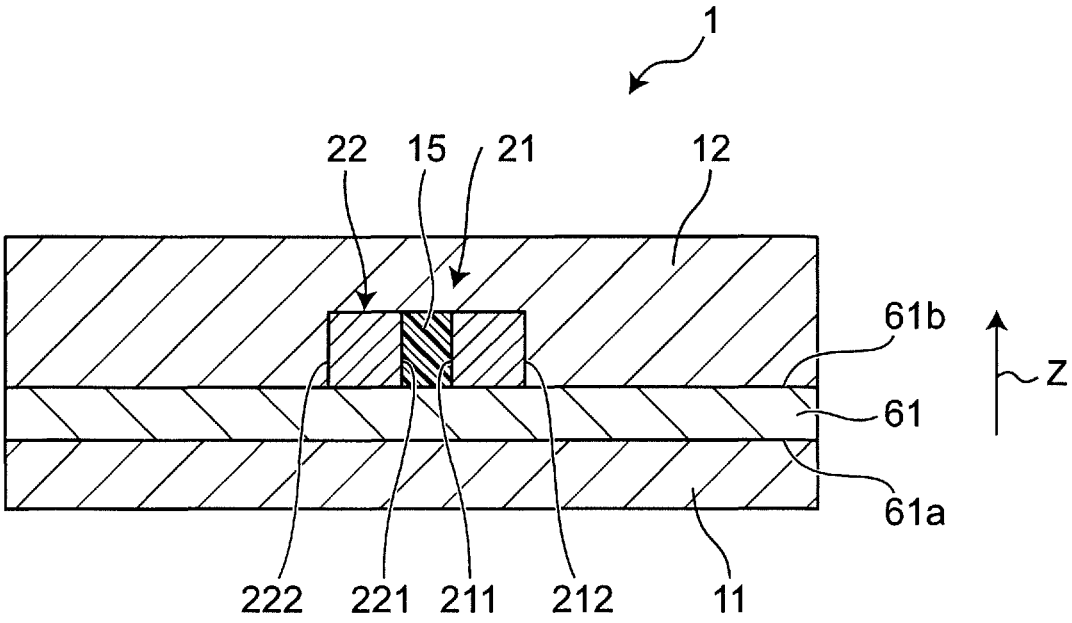
FIG. 1B is a cross-sectional view taken along a line X-X of FIG. 1A.
Figure 1C:
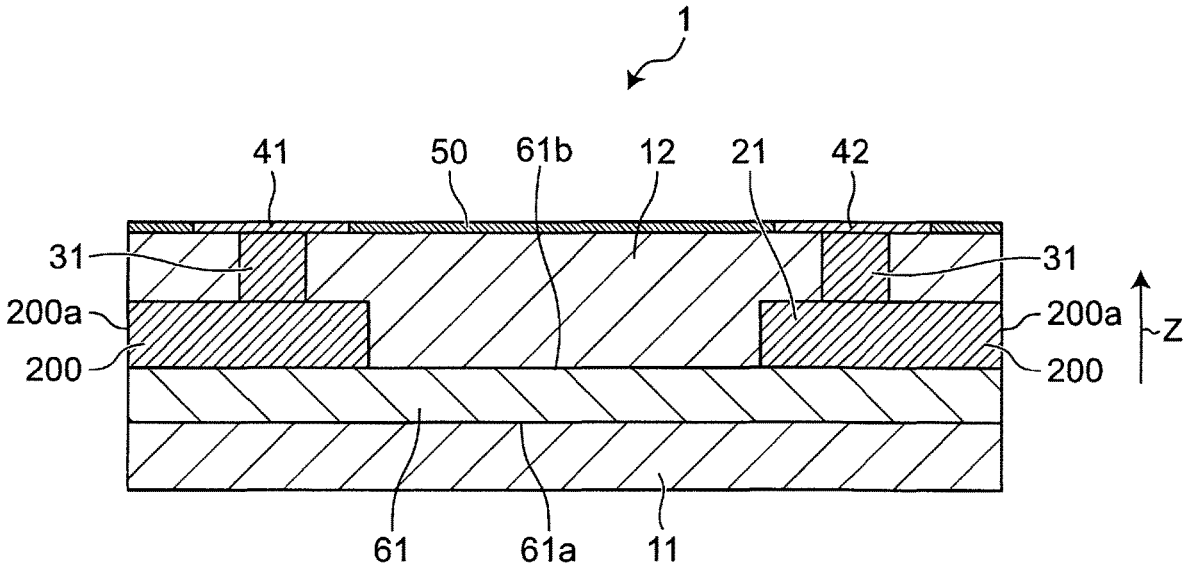
FIG. 1C is a cross-sectional view taken along a line Y-Y of FIG. 1A.

FIG. 1A is a transparent plan view showing a first embodiment of an inductor component. FIG. 1B is a cross-sectional view taken along a line X-X of FIG. 1A. FIG. 1C is a cross-sectional view taken along a line Y-Y of FIG. 1A.

An inductor component 1 is mounted on an electronic device such as a personal computer, a DVD player, a digital camera, a TV, a portable telephone, a smartphone, and automotive electronics, for example, and is a component generally having a rectangular parallelepiped shape, for example. However, the shape of the inductor component 1 is not particularly limited and may be a circular columnar shape, a polygonal columnar shape, a truncated cone shape, or a truncated polygonal pyramid shape.

As shown in FIGS. 1A, 1B, and 1C, the inductor component 1 has a substrate 61, a first magnetic layer 11, a second magnetic layer 12, an insulating layer 15, a first spiral wiring 21, a second spiral wiring 22, a first columnar wiring 31, a second columnar wiring 32, external terminals 41 to 44, and a coating film 50.

The substrate 61 has a flat plate shape and is a portion serving as a base for a manufacturing process of the inductor component 1. The substrate 61 includes a first principal surface 61*a* as a lower surface and a second principal surface 61*b* as an upper surface. A normal direction relative to the principal surfaces 61*a*, 61*b* is defined as a Z direction (up-down direction) in the figures, and in the following description, it is assumed that a forward Z direction faces toward the upper side while a reverse Z direction faces toward the lower side. The Z direction is the same in the other embodiments and examples.

The substrate 61 is polished on the first principal surface 61*a* side, and the thickness of the substrate 61 is 5 μm or more and 100 μm or less (i.e., from 5 μm to 100 μm), for example. For example, the substrate 61 is preferably a sintered body of a magnetic substrate made of NiZn- or MnZn-based ferrite or a nonmagnetic substrate made of alumina or glass. As a result, the strength and flatness of the substrate 61 can be ensured, and a workability of a laminated object on the substrate 61 is improved. However, the substrate 61 is not limited to a sintered body and may be made of a general substrate material such as an epoxy resin impregnated with glass cloth.

The first spiral wiring 21 and the second spiral wiring 22 are disposed on the same plane in the magnetic layers 11, 12 and are adjacent to each other. Specifically, the first spiral wiring 21 and the second spiral wiring 22 are formed only on the upper side of the substrate 61, i.e., on the second principal surface 61*b* of the substrate 61 and are covered with the second magnetic layer 12.

The first and second spiral wirings 21, 22 are wound into a planar shape. Specifically, the first and second spiral wirings 21, 22 have a semi-elliptical arc shape when viewed in the Z direction. Therefore, each of the first and second spiral wirings 21, 22 is a curved wiring wound around about a half of the circumference. The first and second spiral wirings 21, 22 each include a linear part in a middle portion.

The thickness of the first and second spiral wirings 21, 22 is preferably 40 μm or more and 120 μm or less (i.e., from 40 μm to 120 μm), for example. An example of the first and second spiral wirings 21, 22 has a thickness of 45 μm, a wiring width of 50 μm, and an inter-wiring space of 10 μm. The inter-wiring space is preferably 3 μm or more and 20 μm or less (i.e., from 3 μm to 20 μm).

The first and second spiral wirings 21, 22 are made of a conductive material and are made of a metal material having a low electric resistance such as Cu, Ag, and Au, for example. In this embodiment, the inductor component 1 includes only one layer of the first and second spiral wirings 21, 22, so that the inductor component 1 can be reduced in height.

The first and second spiral wirings 21, 22 each have both ends connected to the first columnar wiring 31 and the second columnar wiring 32 located on the outer side and have a curved shape drawing an arc from the first columnar wiring 31 and the second columnar wiring 32 toward the center side of the inductor component 1. The first and second spiral wirings 21, 22 each have both ends provided with pad portions having a line width larger than a spiral-shaped portion and is directly connected at the pad portions to the columnar wirings 31, 32.

It is assumed that an inner diameter portion of each of the first and second spiral wirings 21, 22 is defined as an area surrounded by the curve drawn by the first and second spiral wirings 21, 22 and the straight line connecting both ends of the first and second spiral wirings 21, 22. In this case, neither of the first and second spiral wirings 21, 22 have the inner diameter portions overlapping with each other when viewed in the Z direction.

On the other hand, the first and second spiral wirings 21, 22 are close to each other in respective arc portions. Therefore, the magnetic flux generated in the first spiral wiring 21 goes around the adjacent second spiral wiring 22, and the magnetic flux generated in the second spiral wiring 22 goes around the adjacent first spiral wiring 21. Thus, the first spiral wiring 21 and the second spiral wiring 22 are magnetically coupled.

As shown in FIG. 1A, the first and second spiral wirings 21, 22 have wirings further extending toward the outside of the chip from connecting positions for the columnar wirings 31, 32, and these wirings are exposed to the outside of the chip. Therefore, the first and second spiral wirings 21, 22 have exposed portions 200 exposed to the outside from side surfaces parallel to the lamination direction (Z direction) of the inductor component 1.

The exposed portions 200 are connected to a power feeding wiring when additional electrolytic plating is performed before singulation after a metal film 65 is formed by electrolytic plating in a method of manufacturing the inductor component 1 described later with reference to FIGS. 2A to 2P. Even after a seed layer 63 is removed, additional electrolytic plating can easily be performed with the power feeding wiring, and an inter-wiring distance can further be narrowed between the spiral wirings made up of the seed layer 63 and the metal film 65. Specifically, in the inductor component 1, the inter-wiring distance between the first and second spiral wirings 21, 22 can be narrowed by performing the additional electrolytic plating, so that the magnetic coupling can be enhanced.

Since the spiral wirings 21, 22 have the exposed portions 200, a resistance to electrostatic destruction can be improved at the time of manufacturing. Specifically, in the method of manufacturing the inductor component 1, the exposed portions 200 are connected to a plurality of inductor components through the power feeding wiring before singulation. Therefore, even if static electricity is applied to the wirings in this state, the static electricity can be dispersed through the power feeding wiring and discharged to the ground, so that the resistance to electrostatic destruction can be improved.

In the spiral wirings 21, 22, a thickness of an exposed surface 200*a* of the exposed portion 200 is preferably equal to or less than the thickness of the spiral wirings 21, 22 and is 45 μm or more. As a result, since the thickness of the exposed surface 200*a* is equal to or less than the thickness of the spiral wirings 21, 22, the proportion of the magnetic layers 11, 12 can be increased, and the inductance can be improved. As long as the thickness of the exposed surface 200*a* of the exposed portion 200 is equal to or less than the thickness of at least one of the first spiral wiring 21 and the second spiral wiring 22, the proportion of the magnetic layer 11 can be increased, and the inductance can be improved. Additionally, since the thickness of the exposed surface 200*a* is 45 μm or more, occurrence of disconnection can be reduced. Preferably, the exposed surface 200*a* is an oxide film. As a result, a short circuit can be suppressed between the inductor component 1 and an adjacent component.

The insulating layer 15 is disposed between the first spiral wiring 21 and second spiral wiring 22 adjacent to each other. The insulating layer 15 is a film-shaped layer formed on the second principal surface 61*b* of the substrate 61. The insulating layer 15 is made of an insulating material containing no magnetic substance and is made of a resin material containing at least one of an epoxy resin, a polyimide resin, a phenol resin, and a vinyl ether resin, for example. The insulating layer 15 may contain a filler of a nonmagnetic substance such as silica and, in this case, the insulating layer 15 can be improved in the strength, workability, and electrical characteristics.

The insulating layer 15 is disposed at a position including a region in which a distance is minimum between the first spiral wiring 21 and the second spiral wiring 22 adjacent to each other. Specifically, in the inductor component 1, the insulating layer 15 is disposed at a position including a region in which the arc portions of the adjacent first and second spiral wirings 21, 22 become closest to each other. Therefore, the insulating layer 15 is disposed in the region most likely to cause a problem of insulation where the distance is minimum between the first spiral wiring 21 and the second spiral wiring 22, so that the insulation can further be improved between the first and second spiral wirings 21, 22 adjacent to each other.

The first and second spiral wirings 21, 22 adjacent to each other have first side surfaces 211, 221 facing each other. The insulating layer 15 is in contact with a portion of the first side surface 211 of the first spiral wiring 21 and a portion of the first side surface 221 of the second spiral wiring 22. Therefore, the insulating layer 15 is in contact with the first side surfaces 211, 221 of the arc portions of the first and second spiral wirings 21, 22. As a result, the width of the insulating layer 15 disposed between the first spiral wiring 21 and the second spiral wiring can be ensured larger, and the insulation can further be maintained.

The first magnetic layer 11 is in close contact with the first principal surface 61*a* of the substrate 61. As used herein, the phrase "in close contact" refers to a configuration of contact without interposition of another constituent element and, for example, in the above description, refers to a configuration in which the first principal surface 61*a* of the substrate 61 is in direct contact with the first magnetic layer 11. The second magnetic layer 12 is disposed above the second principal surface 61*b* of the substrate 61. The first and second spiral wirings 21, 22 are disposed between the second magnetic layer 12 and the substrate 61. In this embodiment, the second magnetic layer 12 is formed to cover not only the upper side of the first and second spiral wirings 21, 22 but also the lateral sides of the first and second spiral wirings 21, 22 and the insulting layer 15. As a result, the first and second spiral wirings 21, 22 are disposed in the second magnetic layer 12. The term "above" refers to a configuration in which one of the constituent elements is located on the upper side, including both the case that the constituent elements are in close contact with each other as described above and the case that another constituent element is interposed therebetween, and, for example, in the above description, the second principal surface 61*b* may be in direct contact with the second magnetic layer 12 or another constituent element may be interposed between the second principal surface 61*b* and the second magnetic layer 12.

The first magnetic layer 11 and the second magnetic layer 12 contain a resin containing a powder of a magnetic material. The resin is, for example, an epoxy resin, a phenol resin, a polyimide resin, an acrylic resin, a phenol resin, a vinyl ether resin, and a mixture thereof. The powder of the magnetic material is, for example, a powder of metal magnetic material including an FeSi alloy such as FeSiCr, an FeCo alloy, an Fe alloy such as NiFe, or an amorphous alloy thereof, or a powder of NiZn- or MnZn-based ferrite etc. The content percentage of the magnetic material is preferably 50 vol % or more and 85 vol % or less (i.e., from 50 vol % to 85 vol %) relative to the whole magnetic layer. The powder of the magnetic material preferably has particles of substantially spherical shape, and the average particle diameter is preferably 5 μm or less. The resin constituting the first and second magnetic layers 11, 12 is preferably the same type of material as the insulating layer 15, and in this case, the adhesion between the insulating layer 15 and the first and second magnetic layers 11, 12 can be improved.

If the magnetic powder contains Fe-based magnetic powder, DC superimposition characteristics can be improved. When the Fe-based magnetic powder is FeSiCr and the average particle diameter is 5 μm or less, the DC superimposition characteristics are further improved, and an iron loss at high frequency can be reduced by fine powder. When the resin contains an epoxy resin or an acrylic resin, the insulation among particles of the magnetic powder can be ensured, and an iron loss at high frequency can be made smaller. If the magnetic powder contains ferrite powder, the effective magnetic permeability, i.e., the magnetic permeability per volume of the magnetic layers, can be improved by containing the ferrite having a high relative magnetic permeability.

At least a portion of the first side surface 211 of the first spiral wiring 21 and at least a portion of the first side surface 221 of the second spiral wiring 22 are in contact with the second magnetic layer 12. As a result, since at least portions of the first side surfaces 211, 221 are in contact with the second magnetic layer 12 between the first spiral wiring 21 and the second spiral wiring 22 improved in insulation due to the insulating layer 15 disposed therebetween, the region of the magnetic layer is increased, so that the inductance can effectively be improved while the insulation is ensured.

The first and second spiral wirings 21, 22 have second side surfaces 212, 222 on the side opposite to the first side surfaces 211, 221, respectively, and the second side surfaces 212, 222 are in contact with the second magnetic layer 12. As a result, since the region of the magnetic layer is increased on the side of the second side surfaces 212, 222 not affecting the insulation between the first spiral wiring 21 and the second spiral wiring 22, the inductance can more effectively be improved. Particularly, in the inductor component 1, the second side surfaces 212, 222 are entirely in contact with the second magnetic layer 12, and the effect of improving the inductance can be exerted to the maximum.

The first and second columnar wirings 31, 32 are made of a conductive material, extend from the spiral wirings 21, 22 in the Z direction, and penetrate the inside of the second magnetic layer 12. The first columnar wiring 31 extends upward from an upper surface on one end side and the other end side of the first spiral wiring 21. The second columnar wiring 32 extends upward from an upper surface on one end side and the other end side of the second spiral wiring 22. The columnar wirings 31, 32 are made of the same material as the spiral wirings 21, 22.

The external terminals 41 to 44 are made of a conductive material and has, for example, a three-layer configuration with Cu having low electric resistance and excellent in stress resistance, Ni excellent in corrosion resistance, and Au excellent in solder wettability and reliability arranged in this order from the inside to the outside.

The first external terminal 41 is disposed on an upper surface that is a surface of the second magnetic layer 12 and is connected to one end of the first spiral wiring 21 to cover an end surface of the first columnar wiring 31 exposed from the upper surface. As a result, the first external terminal 41 is electrically connected to one end of the first spiral wiring 21. The second external terminal 42 is disposed on an upper surface that is a surface of the second magnetic layer 12 and is connected to the other end of the first spiral wiring 21 to cover an end surface of the first columnar wiring 31 exposed from the upper surface. As a result, the second external terminal 42 is electrically connected to the other end of the first spiral wiring 21. Similarly, the third external terminal 43 is electrically connected to one end of the second spiral wiring 22. The fourth external terminal 44 is electrically connected to the other end of the second spiral wiring 22.

Therefore, the first columnar wiring 31 connects the first spiral wiring 21 and the first external terminal 41 (or the second external terminal 42), which is one of the multiple external terminals 41 to 44, and the second columnar wiring 32 and connects the second spiral wiring 22 and the third external terminal 43 (or the fourth external terminal 44), which is one of the multiple external terminals 41 to 44.

Preferably, a rust prevention treatment is applied to the external terminals 41 to 44. This rust prevention treatment refers to coating with Ni and Au, or Ni and Sn, etc. This enables the suppression of copper leaching due to solder and the rusting so that the inductor component 1 with high mounting reliability can be provided.

The coating film 50 is made of an insulating material and covers the upper surface of the second magnetic layer 12 to expose the end surfaces of the columnar wirings 31, 32 and the external terminals 41 to 44. With the coating film 50, the insulation of the surface of the inductor component 1 can be ensured. The coating film 50 may be formed on the lower surface side of the first magnetic layer 11.

In the inductor component 1, the thickness of the insulating layer 15 is the same as the thickness of the first and second spiral wirings 21, 22, or may be larger than the thickness of one or both of the first spiral wiring 21 and the second spiral wiring 22. As a result, the insulation can further be improved. Although the insulating layer 15 is in close contact with the first side surfaces 211, 221 of the first and second spiral wirings 21, 22, the magnetic layer 12 may be interposed between the insulating layer 15 and the first side surfaces 211, 221 so that the insulating layer 15 is not in direct contact therewith. As a result, the region of the magnetic layer can further be increased, and the inductance can further be improved.

The substrate 61 may be shaped along the shapes of the first and second spiral wirings 21, 22, or the substrate 61 may not be provided. As a result, since a reduction in proportion of the substrate 61 in the inductor component 1 increases the proportion of the first and second magnetic layers 11, 12 containing the relatively soft resin, the stress absorbability of the inductor component 1 is improved so that the influence of thermal shock, external pressure, etc. can be reduced, and therefore, the reliability of the inductor component 1 can be improved. Additionally, if the first magnetic layer 11 and the second magnetic layer 12 contain the metal magnetic powder, the DC superimposition characteristics of the inductor component 1 can be improved. An insulating layer made of resin may be disposed on the substrate 61, which can improve the adhesion as well as the insulation between the first and second spiral wirings 21, 22 and the substrate 61. An insulating layer made of resin may be disposed instead of the substrate 61, which can improve the adhesion of the first and second spiral wirings 21, 22 and the first magnetic layer 11 in the inductor component 1. Furthermore, since the insulating layer can easily be made thinner than the substrate 61, the height of the inductor component 1 can be reduced, or the characteristics can be improved with respect to the same component height.

On the other hand, the inductor component 1 includes the substrate 61 that is a sintered body having the first principal surface 61*a* in close contact with the first magnetic layer 11 and the second principal surface 61*b* above which the second magnetic layer 12 is disposed, and the spiral wirings 21, 22 disposed between the second magnetic layer 12 and the substrate 61.

As a result, laminated objects such as the second magnetic layer 12 and the spiral wirings 21, 22 above the second principal surface 61*b* can be formed on the second principal surface 61*b* of the stable substrate 61 that is a sintered body, and therefore, the formation accuracy of the laminated objects can be improved. Since the first principal surface 61*a* is in close contact with the first magnetic layer 11, the spiral wirings 21, 22 are not formed on the first principal surface 61*a*. As a result, even if the thickness of the substrate 61 is ensured to some extent so as to improve the formation accuracy of the laminated objects, the substrate 61 can be processed by polishing etc. from the first principal surface 61*a* side, so that the thickness can be reduced after the laminated objects are formed on the second principal surface 61*b*. Therefore, both the formation accuracy and the height reduction of the inductor component 1 can be achieved. Additionally, since the substrate 61 is not completely removed, the laminated objects such as the spiral wirings 21, 22, the second magnetic layer 12, and the insulating layer 15 can be protected from the processing, and mass-production variations in DC electrical resistance (Rdc) etc. can be suppressed. Furthermore, by adding a processing amount of the substrate 61 as an adjustment element to a manufacturing process, a degree of design freedom can be improved in terms of the strength, inductance, height dimension, etc. of the inductor component 1, and the mass-production variations thereof can be reduced.

Columnar wirings may be disposed such that the wirings are led out from the spiral wirings 21, 22 to the lower surface of the inductor component 1. In this case, external terminals connected to the columnar wirings may be disposed on the lower surface of the inductor component 1. This can improve a degree of freedom of connection between the inductor component 1 and another circuit component.

Although the inductor component 1 has the two spiral wirings 21, 22, the present disclosure is not limited to this configuration, and three or more spiral wirings may be included on the same plane.

Although the spiral wirings 21, 22 are curves having the number of turns less than one and have a portion that is a straight line, the spiral wirings may be curves (two-dimensional curves) formed in a plane and may be curves having the number of turns exceeding one. Preferably, the substrate 61 is a magnetic substance. As a result, a region of the magnetic substance is increased in the inductor component 1, so that L can be improved.

Preferably, the first and second magnetic layers 11, 12 contain a metal magnetic powder contained in a resin, and the substrate 61 is a sintered body of ferrite. As a result, the DC superimposition characteristics can be improved by the first magnetic layer 11 and the second magnetic layer 12 containing the metal magnetic powder.

Preferably, the first and second magnetic layers 11, 12 further contain a ferrite powder. As a result, the effective magnetic permeability, i.e., the magnetic permeability per volume of the first and second magnetic layers 11, 12, can be improved by containing not only the metal magnetic powder but also the ferrite having a high relative magnetic permeability.

Preferably, the sum of the thickness of the first magnetic layer 11 and the thickness of the second magnetic layer 12 is larger than the thickness of the substrate 61. In other words, the sum of the volume of the first magnetic layer 11 and the volume of the second magnetic layer 12 is larger than the volume of the substrate 61. As a result, since the proportion of the magnetic layers 11, 12 containing a relatively soft resin becomes large, the stress absorbability of the inductor component 1 is improved, and an influence of thermal shock, external pressure, etc. can be reduced, so that the reliability of the inductor component 1 is improved. Additionally, if the first and second magnetic layers 11, 12 contain the metal magnetic powder, the DC superimposition characteristics of the inductor component 1 can be improved.

Preferably, the thickness of the first magnetic layer 11 and the thickness of the second magnetic layer 12 are both greater than the thickness of the substrate 61. As a result, since the proportion of the magnetic layers 11, 12 containing a relatively soft resin becomes larger, the stress absorbability of the inductor component 1 is further improved, and an influence of thermal shock, external pressure, etc. can be reduced, so that the reliability of the inductor component 1 is further improved. Additionally, if the first and second magnetic layers 11, 12 contain the metal magnetic powder, the DC superimposition characteristics of the inductor component 1 can further be improved.

Preferably, the electrical resistivity of the first magnetic layer 11 and the electrical resistivity of the second magnetic layer 12 are higher than the electrical resistivity of the substrate 61. As a result, an iron loss, i.e., a loss due to a material, can be reduced by including a portion having a high electrical resistivity.

Specifically, a method of measuring the electrical resistivity in the present application may include: forming an electrode of a gallium-indium alloy on an object to be measured taken out by polishing or cutting; measuring an electrical resistance at an applied voltage of 1.0 V at room temperature by using an insulation resistance meter; and making a calculation based on a formed electrode area and an interelectrode distance with the following equation: electrical resistivity (Ω·m)=electrical resistance (Ω)×(electrode area ($m^2$)/interelectrode distance (m). An object to be measured in a material state may be hardened by applying pressure, heat, etc., before measurement. For example, the electrical resistivity of the first magnetic layer 11 and the second magnetic layer 12 is on the order of $1.0\times10^{11\ to\ 12}$ Ω·m, and the electrical resistivity of the substrate 61 is on the order of $1.0\times10^{9\ to\ 10}$ Ω·m.

Preferably, the substrate 61 has a crack portion. The crack portion is formed by fracture inside the substrate 61. As a result, a stress is released in the crack portion, and the impact resistance of the inductor component 1 is improved.

Preferably, the spiral wirings 21, 22 have a spiral-shaped first conductor layer, and a second conductor layer disposed on the first conductor layer and shaped along the first conductor layer, and the thickness of the first conductor layer is 0.5 μm or more. As a result, the unevenness of the substrate 61 can be absorbed by the thickness of the first conductor layer, and the formation and processing of the second conductor layer are facilitated, so that the formation accuracy of the inductor component 1 is improved.

Preferably, the spiral wirings 21, 22 have a spiral-shaped first conductor layer and a second conductor layer disposed on the first conductor layer and shaped along the first conductor layer, and the Ni content percentage of the first conductor layer is 5.0 wt % or less. As a result, a difference can be reduced between the electric conductivity of the first conductor layer and the electric conductivity of the second conductor layer, and the current flowing through the spiral wirings flows substantially uniformly in cross sections of the first conductor layer and the second conductor layer, so that heat generation can be made uniform in the spiral wirings. Additionally, Rdc of the spiral wirings is reduced. In this case, it can be said that the first conductor layer is not formed by electroless plating.

As described above, if the first conductor layer is not formed by electroless plating, the first magnetic layer 11 can be prevented from being affected by a process of applying a catalyst to the first magnetic layer 11, an electroless plating process (a seed layer forming step), and a process of etching a conductor layer formed by electroless plating (a seed layer removing step). Specifically, the first magnetic layer 11 contains a magnetic powder, and the magnetic powder can be restrained from being removed by a plating solution, an etching solution, etc. used in a pretreatment or a process at the time of formation of the first conductor layer. Therefore, as described above, if the first conductor layer has a feature that the layer is not formed by electroless plating, the first magnetic layer 11 can be prevented from decreasing in magnetic permeability and decreasing in strength.

In a method of measuring the Ni content percentage, after performing a pretreatment for making a boundary between the first conductor layer and the second conductor layer clear as needed, the Ni content percentage (wt %) on the first conductor layer side is calculated by performing EDX analysis with a scanning transmission electron microscope (STEM). Regarding the pretreatment, for example, a wiring having the first conductor layer and the second conductor layer may be exposed on a cross section by polishing or milling, and the cross section may thinly be etched by dry etching with Ar or wet etching with nitric acid so that the boundary between the first conductor layer and the second conductor layer thereby becomes clearer due to a difference in etching rate. However, regardless of the presence/absence of the pretreatment, the first conductor layer may be determined from a continuity and a particle size of particles by STEM. The EDX analysis may be performed by using, for example, JEM-2200FS manufactured by JEOL as STEM and Noran System 7 manufactured by Thermo Fisher Scientific as an EDX system at the magnification of 400 k (magnification of 400 k or more as needed).

Preferably, the line width of the first conductor layer is different from the line width of the second conductor layer. The line width of the first conductor layer refers to the maximum value of the width of the first conductor layer, and the line width of the second conductor layer refers to the maximum value of the width of the second conductor layer. As a result, a combination of formation methods of conductor layers forming various shapes can be employed, which increases a degree of design freedom of the spiral wiring 21.

The line width of the first conductor layer is preferably larger than the line width of the second conductor layer and, as a result, the spiral wiring 21 has a forward tapered shape widened on the bottom side and narrowed on the top side, so that the second magnetic layer 12 is easily filled in the vicinity of the side surfaces of the spiral wiring 21.

Figure 1D:
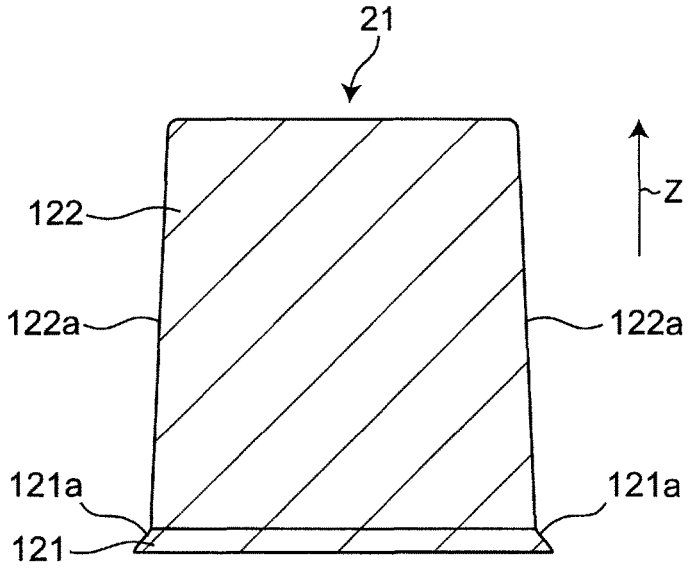
FIG. 1D is an enlarged cross-sectional view showing a preferable form of a spiral wiring.

Preferably, as shown in FIG. 1D, the spiral wiring 21 has a spiral-shaped first conductor layer 121 and a second conductor layer 122 disposed on the first conductor layer 121 and shaped along the first conductor layer 121. A taper angle of a side surface 121*a* of the first conductor layer 121 is larger than a taper angle of a side surface 122*a* of the second conductor layer 122. The side surface 121*a* of the first conductor layer 121 refers to a surface in the width direction of the first conductor layer 121, and the side surface 122*a* of the second conductor layer 122 refers to a surface in the width direction of the second conductor layer 122. As a result, the spiral wiring 21 is forward tapered so that the second magnetic layer 12 can easily be filled between wirings of the spiral wiring 21.

For example, the taper angle of the side surface 121*a* of the first conductor layer 121 is 30.0°, and the taper angle of the side surface 122*a* of the second conductor layer 122 is 1.2°. In this case, based on the Z direction (0°), the angle is positive when a taper shape is formed, and the angle is negative when a reverse taper shape is formed. The taper angle may accurately be measured in a region of 80% excluding upper/lower 20% of the thickness of each of the first conductor layer 121 and the second conductor layer 122.

The present disclosure is not limited to the relationships of the line width and the taper angle of FIG. 1D and, for example, the line width or the taper angle of the first conductor layer 121 may be smaller than the line width or taper angle of the second conductor layer 122.

The substrate 61 may be provided with a hole portion at a position corresponding to the inner circumferential portion of the spiral wirings 21, 22 so that either or both of the first magnetic layer 11 and the second magnetic layer 12 can be disposed in the hole portion of the substrate 61, and since an increase in proportion of the first and second magnetic layers 11, 12 containing the relatively soft resin improves the stress absorbability of the inductor component 1 so that the influence of thermal shock, external pressure, etc. can be reduced, the reliability of the inductor component 1 can be improved. Additionally, if the first magnetic layer 11 and the second magnetic layer 12 contain the metal magnetic powder, the DC superimposition characteristics of the inductor component 1 can be improved.

(Manufacturing Method)

A manufacturing method of the inductor component 1 will be described. Unless otherwise stated, the following description will be made with reference to the drawings of the cross section taken along the line Y-Y of FIG. 1A.

Figure 2A:
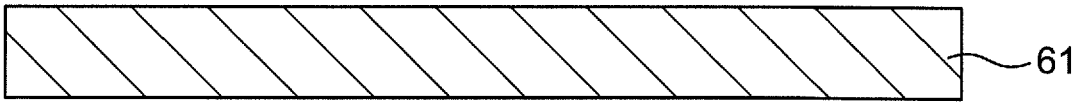
FIG. 2A is an explanatory view for explaining a manufacturing method of the inductor component according to the first embodiment.

As shown in FIG. 2A, the substrate 61 is prepared. The substrate 61 is a flat plate-shaped substrate made of sintered ferrite, for example. Since the thickness of the substrate 61 does not affect the thickness of the inductor component, the substrate with easy-to-handle thickness may appropriately be used for the reason of warpage due to processing etc.

Figure 2B:
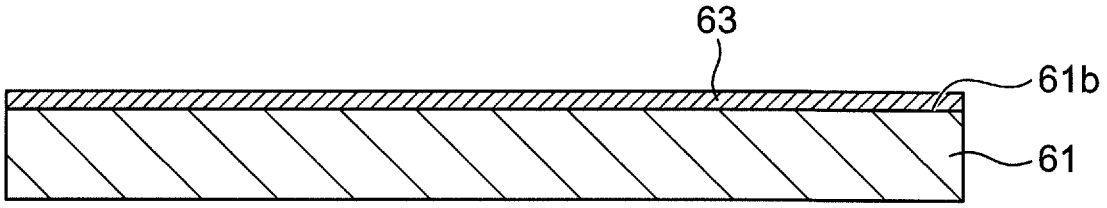
FIG. 2B is an explanatory view for explaining a manufacturing method of the inductor component according to the first embodiment.
Figure 2C:
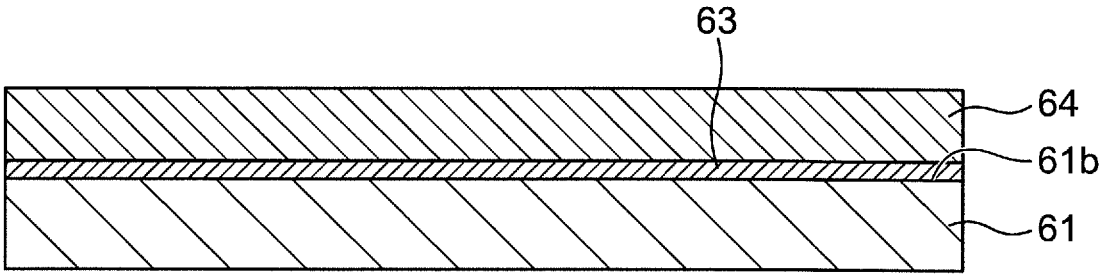
FIG. 2C is an explanatory view for explaining a manufacturing method of the inductor component according to the first embodiment.
Figure 2D:
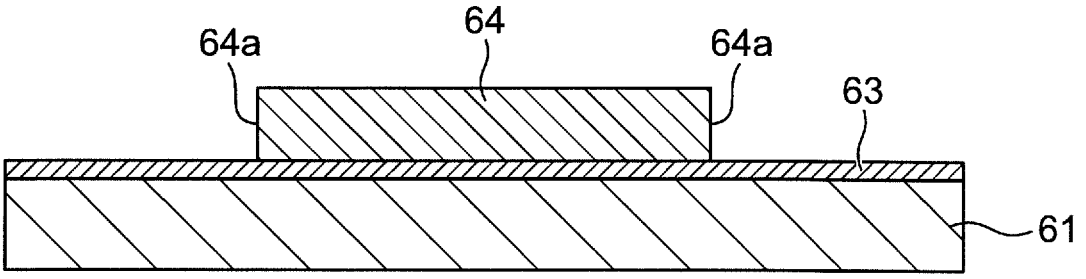
FIG. 2D is an explanatory view for explaining a manufacturing method of the inductor component according to the first embodiment.

As shown in FIG. 2B, a seed layer 63 of Cu is formed on the second principal surface 61*b* of the substrate 61 by sputtering, electroless plating, etc. The seed layer 63 may be formed on another substrate by electrolytic plating and transferred to the substrate 61. As shown in FIG. 2C, a dry film resist (DFR) 64 is affixed onto the seed layer 63. As shown in FIG. 2D, the DFR 64 is patterned by photolithography to form a through-hole 64*a* in a region for forming the spiral wiring, so that the seed layer 63 is exposed from the through-hole 64*a*.

Figure 2E:
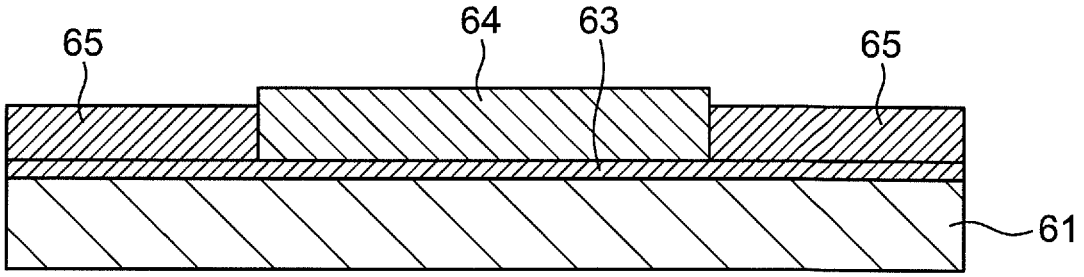
FIG. 2E is an explanatory view for explaining a manufacturing method of the inductor component according to the first embodiment.
Figure 2F:
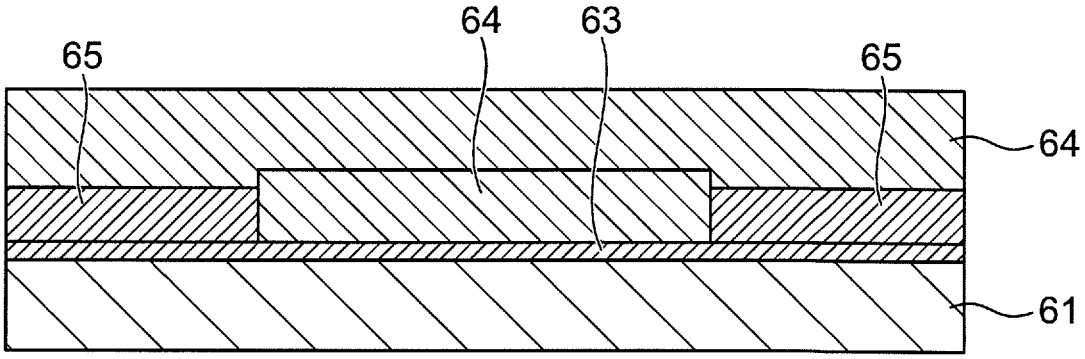
FIG. 2F is an explanatory view for explaining a manufacturing method of the inductor component according to the first embodiment.

As shown in FIG. 2E, a metal film 65 is formed on the seed layer 63 in the through-hole 64*a* by electroplating. As shown in FIG. 2F, after formation of the metal film 65, the DFR 64 is further affixed.

Figure 2G:
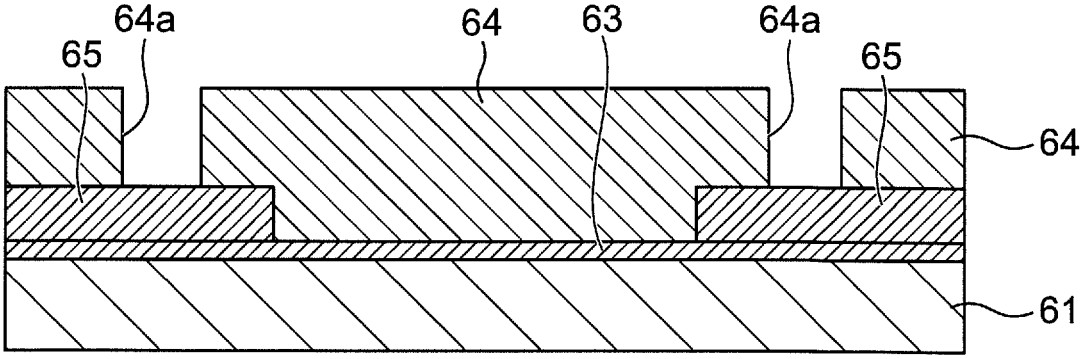
FIG. 2G is an explanatory view for explaining a manufacturing method of the inductor component according to the first embodiment.
Figure 2H:
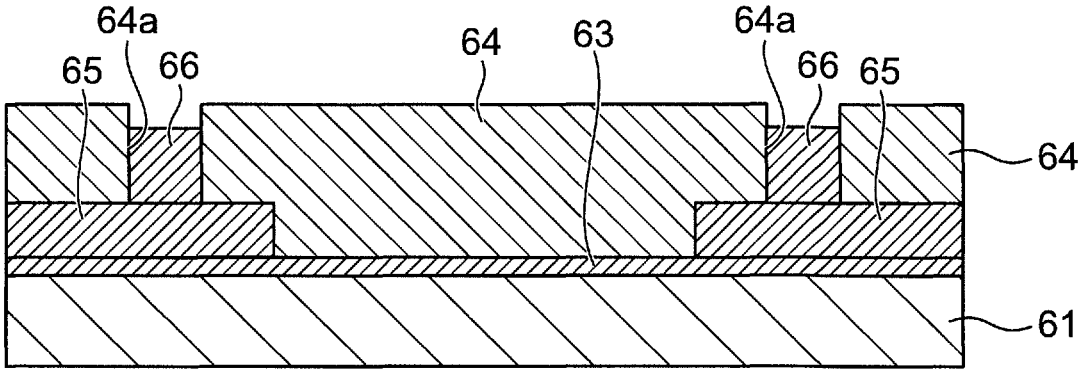
FIG. 2H is an explanatory view for explaining a manufacturing method of the inductor component according to the first embodiment.

As shown in FIG. 2G, the DFR 64 is patterned by photolithography, and the through-hole 64*a* is formed in a region for forming the columnar wiring, so that the metal film 65 is exposed from the through-hole 64*a*. As shown in FIG. 2H, a metal film 66 is further formed by electrolytic plating on the metal film 65 in the through-hole 64*a*.

Figure 2I:
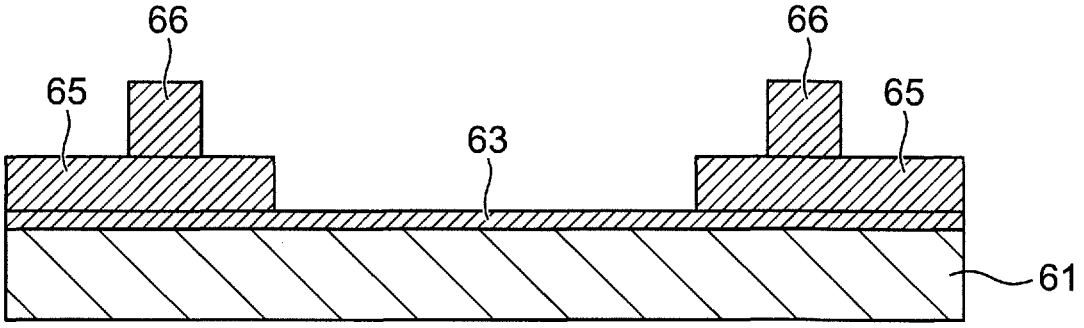
FIG. 2I is an explanatory view for explaining a manufacturing method of the inductor component according to the first embodiment.
Figure 2J:
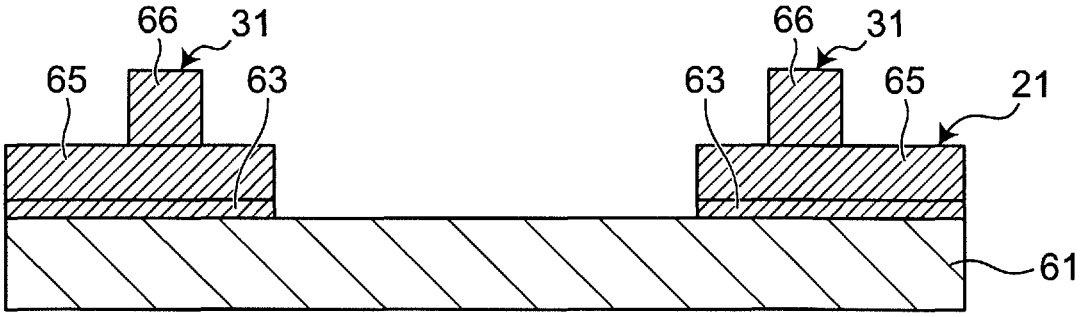
FIG. 2J is an explanatory view for explaining a manufacturing method of the inductor component according to the first embodiment.

As shown in FIG. 2I, the DFR 64 is removed, and as shown in FIG. 2J, the seed layer 63 is removed by etching in an exposed portion on which the metal film 65 is not formed. As a result, the spiral wiring 21 is formed on the first principal surface such that the spiral wiring is wound on the upper surface (the first principal surface) of the insulating layer 62, and the columnar wirings 31, 32 are formed as wirings extending from the spiral wiring 21 in the normal direction of the first principal surface. Therefore, the columnar wirings 31, 32 are formed after formation of the spiral wiring 21 and before formation of the magnetic layer.

Figure 2K:
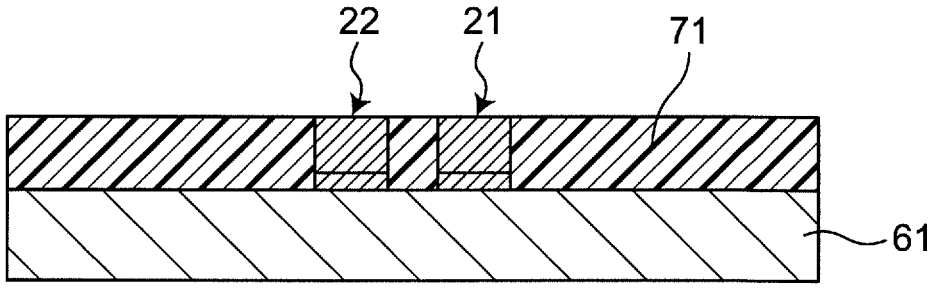
FIG. 2K is an explanatory view for explaining a manufacturing method of the inductor component according to the first embodiment.
Figure 2L:
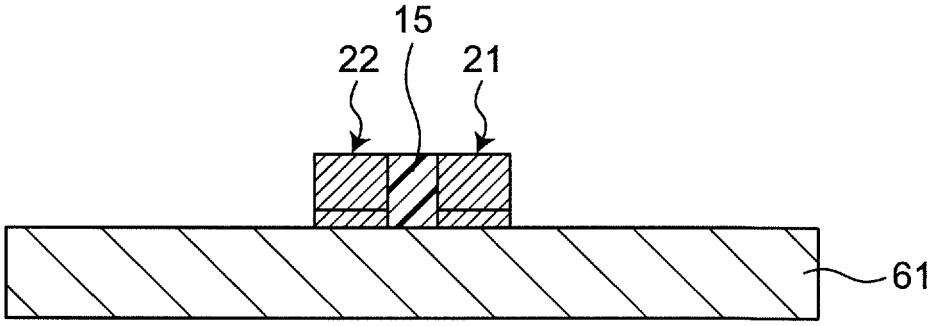
FIG. 2L is an explanatory view for explaining a manufacturing method of the inductor component according to the first embodiment.

As shown in FIG. 2K, an insulating sheet 71 made of an insulating material not containing a magnetic substance is pressure-bonded to the upper-surface side (spiral wiring side) of the substrate 61, and, as shown in FIG. 2L, patterning is performed by laser, photolithography, etc. to form the insulating layer 15. Instead of the insulating sheet 71, an insulating paste may be applied. FIGS. 2K and 2L are the drawings of the cross section taken along the line X-X of FIG. 1A.

Figure 2M:
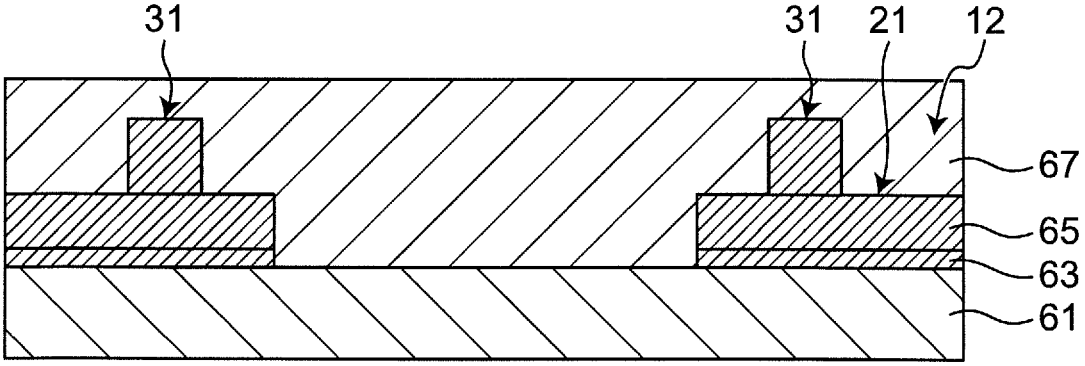
FIG. 2M is an explanatory view for explaining a manufacturing method of the inductor component according to the first embodiment.

As shown in FIG. 2M, a magnetic sheet 67 made of a magnetic material is pressure-bonded to the upper-surface side (spiral wiring formation side) of the substrate 61. As a result, the second magnetic layer 12 is formed on the substrate 61 in contact with at least a portion of the spiral wiring 21 (the side surface of the spiral wiring 21 and the upper surface of the spiral wiring 21 except the portions in contact with the columnar wiring 31, 32).

Figure 2N:
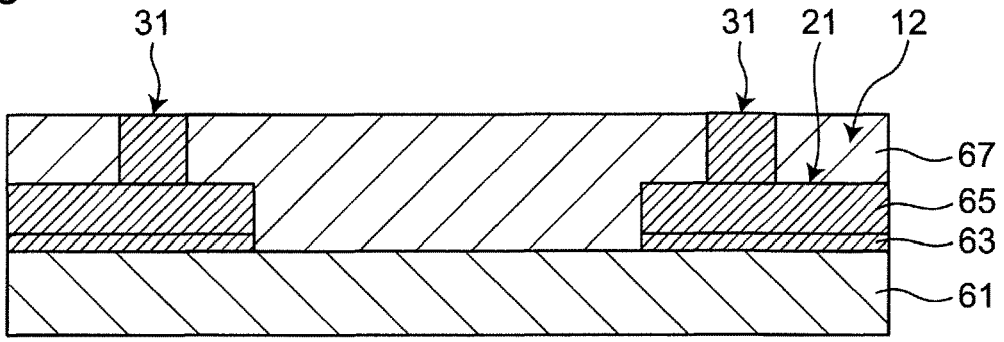
FIG. 2N is an explanatory view for explaining a manufacturing method of the inductor component according to the first embodiment.
Figure 2O:
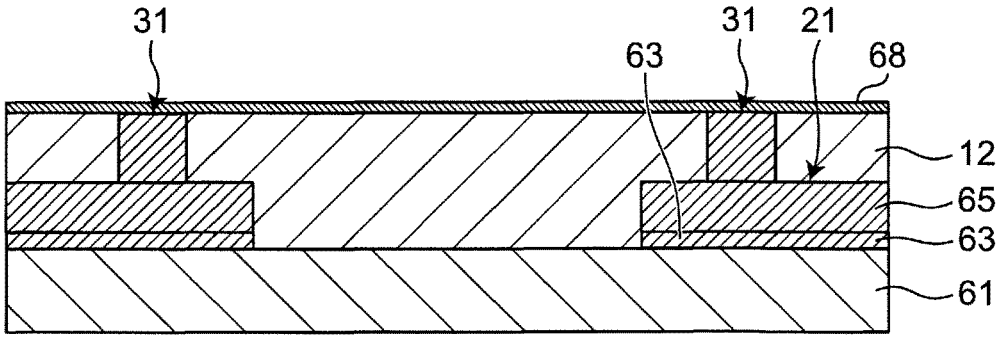
FIG. 2O is an explanatory view for explaining a manufacturing method of the inductor component according to the first embodiment.

As shown in FIG. 2N, the magnetic sheet 67 is polished to expose the upper ends of the columnar wirings 31, 32 (the metal film 66). As shown in FIG. 2O, a solder resist (SR) 68 is formed as the coating film 50 on the upper surface (the first principal surface) of the magnetic sheet 67.

Figure 2P:
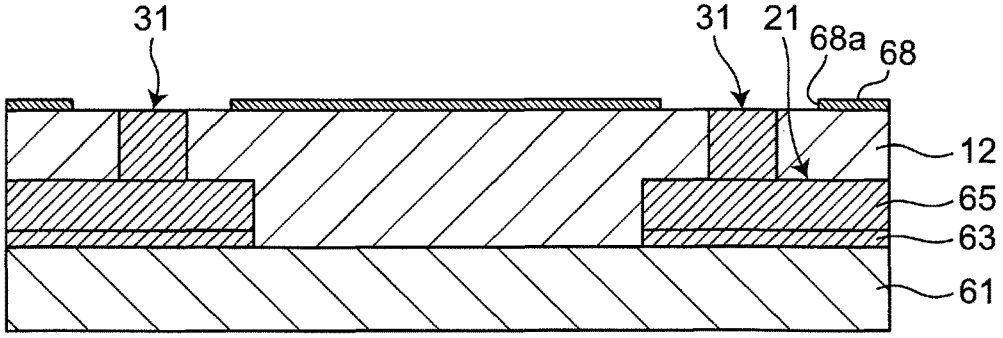
FIG. 2P is an explanatory view for explaining a manufacturing method of the inductor component according to the first embodiment.

As shown in FIG. 2P, the SR 68 is patterned by photolithography to form through-holes 68*a* through which the columnar wirings 31, 32 (the metal film 66) and the second magnetic layer 12 (the magnetic sheet 67) are exposed, in a region for forming external terminals.

Figure 2Q:
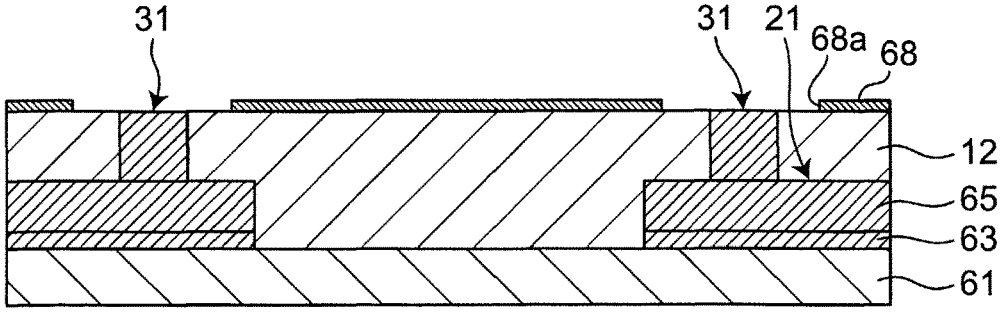
FIG. 2Q is an explanatory view for explaining a manufacturing method of the inductor component according to the first embodiment.
Figure 2R:
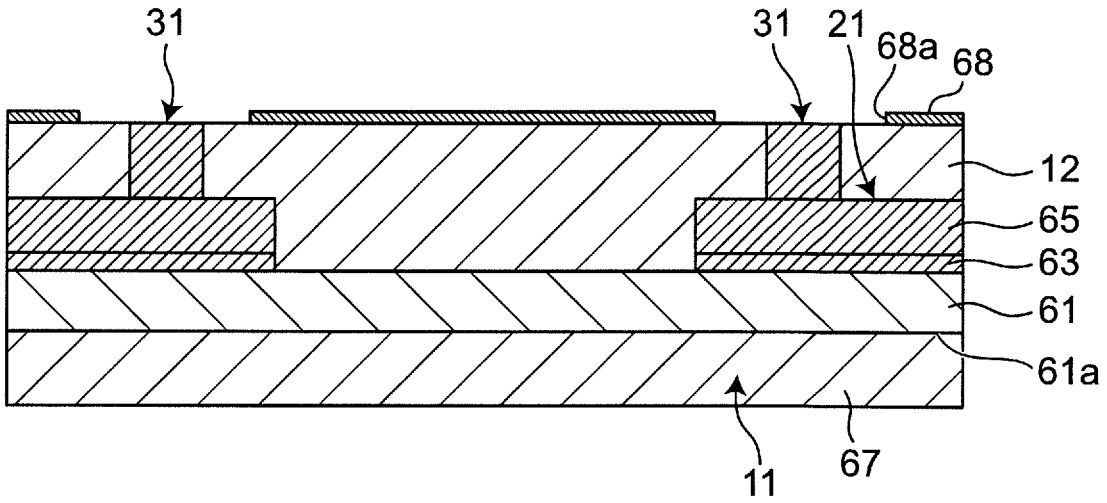
FIG. 2R is an explanatory view for explaining a manufacturing method of the inductor component according to the first embodiment.

As shown in FIG. 2Q, the substrate 61 is polished from the first principal surface 61*a* side. In this case, the substrate 61 is not completely removed and is partially left. As shown in FIG. 2R, the magnetic sheet 67 made of a magnetic material is pressure-bonded to the first principal surface 61*a* on the polished side of the substrate 61 and is polished to an appropriate thickness.

Figure 2S:
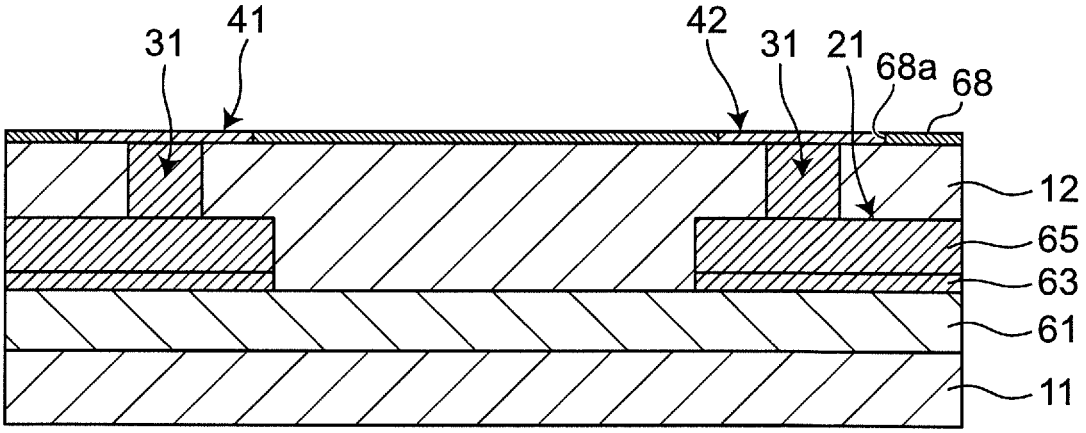
FIG. 2S is an explanatory view for explaining a manufacturing method of the inductor component according to the first embodiment.
Figure 2T:
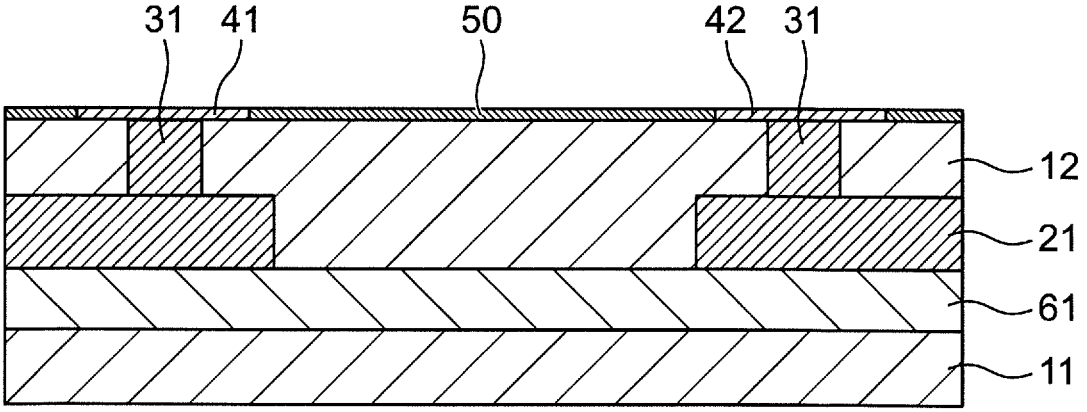
FIG. 2T is an explanatory view for explaining a manufacturing method of the inductor component according to the first embodiment.

As shown in FIG. 2S, a metal film 69 of Cu/Ni/Au is formed by electroless plating and grown from the columnar wirings 31, 32 into the through-holes 68*a* of the SR 68. The metal film 69 forms the first external terminal 41 connected to the first columnar wiring 31 and the second external terminal 42 connected to the second columnar wiring 32. As shown in FIG. 2T, individual pieces are formed and subjected to barrel polishing as needed, and burrs are removed to manufacture the inductor component 1.

The manufacturing method of the inductor component 1 is merely an example, and techniques and materials used in steps may appropriately be replaced with other known techniques and materials. For example, although the DFR 64 and the SR 68 are patterned after coating in the above description, the DFR 64 and the SR 68 may directly be formed on necessary portions by application, printing, mask vapor deposition, lift-off, etc. Although polishing is used for removal of the substrate 61 and thinning of the magnetic sheet 67, another physical process such as blasting and laser or a chemical process such as hydrofluoric acid treatment may be used. Alternatively, all of the substrate 61 may be removed.

Second Embodiment

Figure 3A:
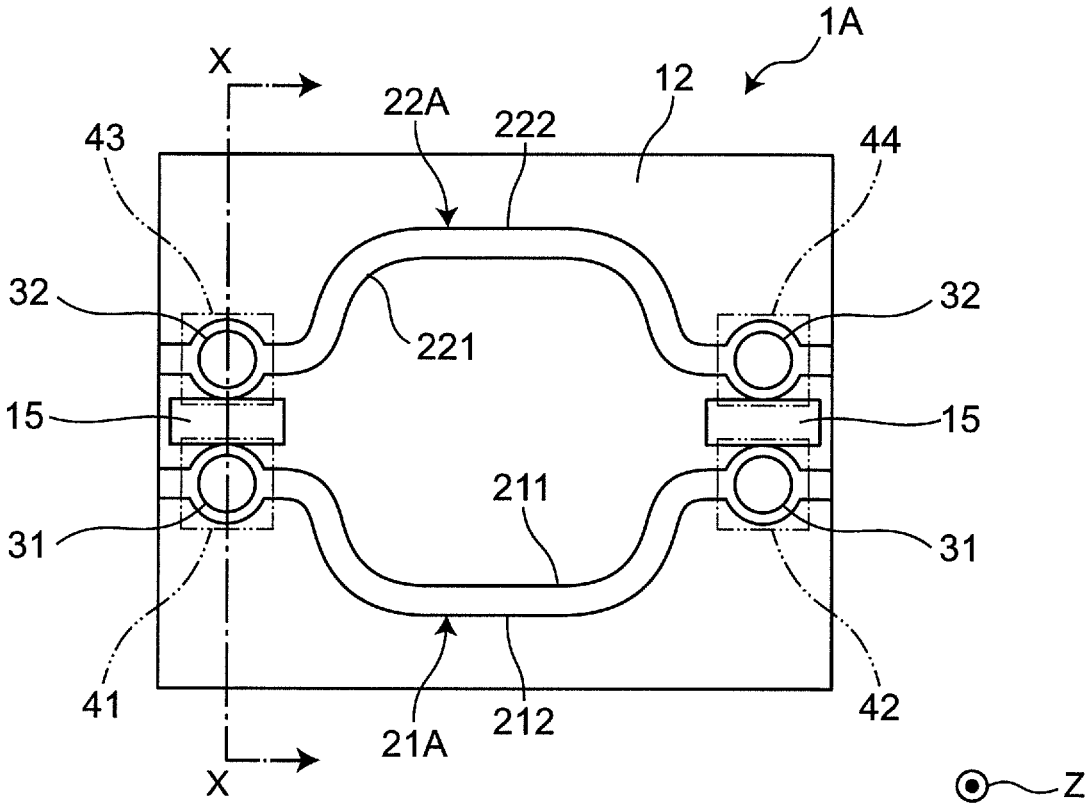
FIG. 3A is a transparent plan view showing an inductor component according to a second embodiment.
Figure 3B:
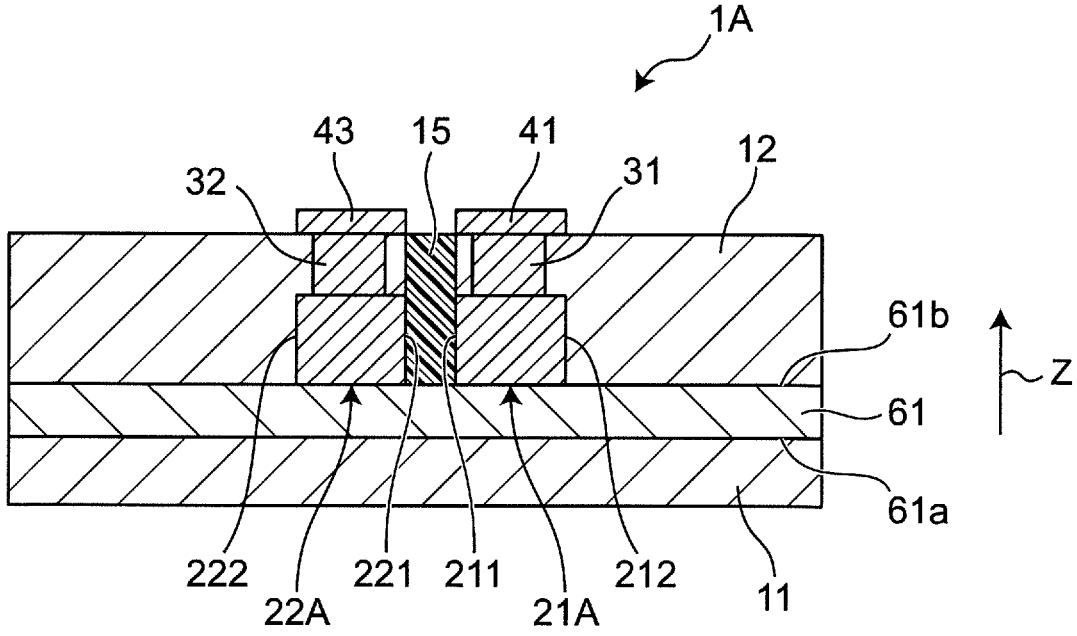
FIG. 3B is a cross-sectional view taken along a line X-X of FIG. 3A.

FIG. 3A is a transparent perspective view showing a second embodiment of an inductor component. FIG. 3B is a cross-sectional view taken along a line X-X of FIG. 3A. The second embodiment is different from the first embodiment in the configuration of the insulating layer and the spiral wiring. This different configuration will hereinafter be described. The other constituent elements have the same configuration as the first embodiment and are denoted by the same reference numerals as the first embodiment and will not be described.

As shown in FIGS. 3A and 3B, in an inductor component 1A of the second embodiment, as compared to the inductor component 1 of the first embodiment, while the arc portions of the spiral wirings 21, 22 of the first embodiment come closer to each other, arc portions of spiral wirings 21A, 22A of the second embodiment are separated away from each other. Therefore, a portion of a minimum distance between the first and second spiral wirings 21A, 22A of the second embodiment is a portion between an end portion of the first spiral wiring 21A and an end portion of the second spiral wiring 22A.

The insulating layer 15 is disposed between the end portions of the first and second spiral wirings 21A, 22A. In this case, the insulating layer 15 is in contact with the first side surface 211 of the end portion of the first spiral wiring 21A and the first side surface 221 of the end portion of the second spiral wiring 22A. The insulating layer 15 may be interposed via the second magnetic layer 12 between the first side surfaces 211, 221 of the first and second spiral wirings 21A, 22A.

Furthermore, the insulating layer 15 is also disposed between one end sides, and between the other end sides, of the first and second columnar wirings 31, 32 respectively connected to the first and second spiral wirings 21A, 22A. In this case, the insulating layer 15 is interposed via the second magnetic layer 12 between the one end sides, and between the other end sides, of the first and second columnar wirings 31, 32. The insulating layer 15 may be in contact with the columnar wirings 31, 32.

Therefore, the insulating layer 15 is disposed not only between the first and second spiral wirings 21A, 22A but also between the first columnar wirings 31, 31 and the second columnar wirings 32, 32, so that the insulation can further be improved.

For a method of disposing the insulating layer 15 also between the first and second columnar wirings 31, 32, for example, a thickness, a pressure bonding condition, and a patterning condition of the insulating sheet 71 shown in FIG. 2K may appropriately be selected.

Third Embodiment

Figure 4:
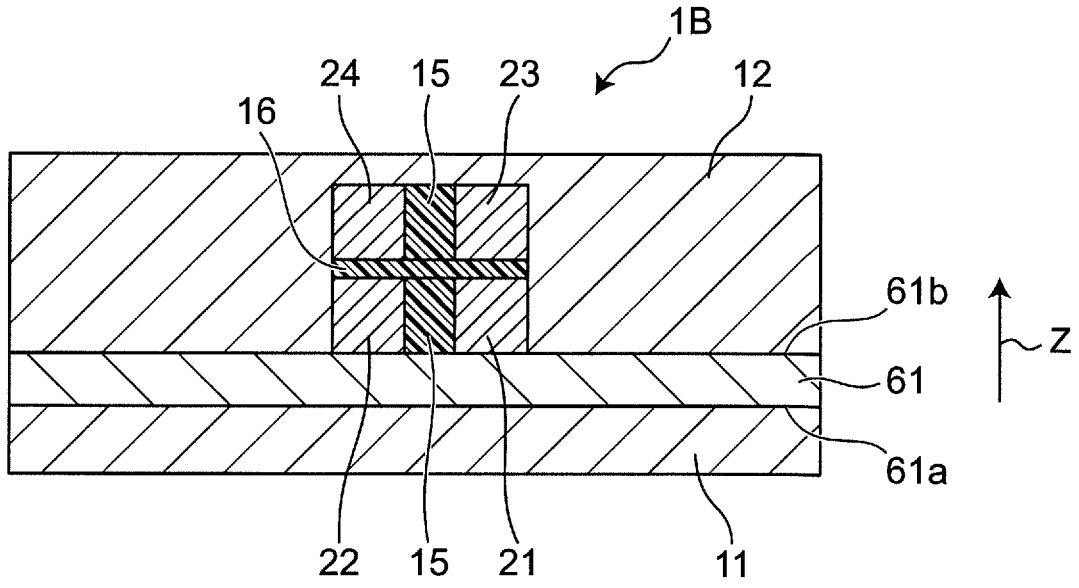
FIG. 4 is a cross-sectional view showing an inductor component according to a third embodiment.

FIG. 4 is a cross-sectional view showing a third embodiment of an inductor component. The third embodiment is different from the first embodiment in configuration of the spiral wiring. This different configuration will hereinafter be described. The other constituent elements have the same configuration as the first embodiment and are denoted by the same reference numerals as the first embodiment and will not be described.

As shown in FIG. 4, in an inductor component 1B of the third embodiment, as compared to the inductor component 1 of the first embodiment, upper spiral wirings 23, 24 are located above the spiral wirings 21, 22, and the lower spiral wirings 21, 22 and the upper spiral wirings 23, 24 are electrically connected in parallel by via conductors not shown.

Specifically, the inductor component 1B further includes the third spiral wiring 23 disposed above the first spiral wiring 21, and the first spiral wiring 21 and the third spiral wiring 23 have inner circumferential ends connected to each other and outer circumferential ends connected to each other by the via conductors and are thereby electrically connected in parallel. Similarly, the inductor component 1B further includes the fourth spiral wiring 24 disposed above the second spiral wiring 22, and the second spiral wiring 22 and the fourth spiral wiring 24 have inner circumferential ends connected to each other and outer circumferential ends connected to each other by the via conductors and are thereby electrically connected in parallel. This can substantially increase the wiring cross-sectional area in the same current path, so that Rdc can be reduced.

The inductor component 1B further includes an interlayer insulating layer 16 disposed between the lower first and second spiral wirings 21, 22 and the upper third and fourth spiral wirings 23, 24. In this case, the thickness of the interlayer insulating layer 16 is preferably smaller than the width of the insulating layer 15. The width of the insulating layer 15 is the width in the direction between the adjacent spiral wirings 21, 22. The first spiral wiring 21 and the third spiral wiring 23 electrically connected in series have substantially the same potential, and the second spiral wiring 22 and the fourth spiral wiring 24 electrically connected in series have substantially the same potential as well. Therefore, even when the interlayer insulating layer 16 has a thickness made smaller than the width of the insulating layer 15 disposed between the first and second spiral wirings 21, 22 and between the third and fourth spiral wirings 23, 24 causing a large potential difference, an influence on the insulation is small, and the region of the magnetic layer 12 can accordingly be increased to more effectively achieve the improvement in the inductance. Additionally, the thickness of the interlayer insulating layer 16 can be reduced and this reduction can be utilized for reducing the height of the inductor component 1B so that a height reduction can be achieved. Although not shown, the via conductors penetrate the inside of the interlayer insulating layer 16.

In the inductor component 1B, the lower first and second spiral wirings 21, 22 and the upper third and fourth spiral wirings may electrically be connected in series, and this can improve the inductance. Specifically, in this case, the first and second spiral wirings 21, 22 and the third and fourth spiral wirings have the inner circumferential ends connected to each other by via conductors penetrating the inside of the interlayer insulating layer 16 and are thereby electrically connected in series. As described above, in the inductor component 1B, the first spiral wiring (second spiral wiring) and the third spiral wiring (fourth spiral wiring) may electrically be connected, and as a result, a degree of design freedom can be improved.

The present disclosure is not limited to the embodiments described above and may be changed in design without departing from the spirit of the present disclosure. For example, respective feature points of the first to third embodiments may variously be combined.

In the embodiments, both the first side surface 211 of the first spiral wiring 21 and the first side surface 221 of the second spiral wiring 22 are at least partially in contact with the second magnetic layer 12; however, only one of the first side surfaces 211, 221 may at least partially be in contact with the second magnetic layer 12.

In the third embodiment, two layers of spiral wirings connected in series are included; however, the present disclosure is not limited thereto, and the number of spiral wirings connected in series may be three or more.

In the embodiments, the spiral wirings 21, 22 are in close contact with both the second principal surface 61*b* of the substrate 61 and the second magnetic layer 12; however, the present disclosure is not limited thereto, and the spiral wirings 21, 22 may be in close contact with only the second principal surface 61*b* or only the second magnetic layer 12, while the insulating layer 15 may be interposed for the other portions. Furthermore, in the embodiments, the spiral wiring 21 is in close contact with the second magnetic layer 12 on the second side surfaces 212, 222 and the upper surface; however, only one of the second side surfaces 212, 222 and the upper surface may be in close contact, while the insulating layer 15 may be interposed for the other surface, or the second side surfaces 212, 222 or the upper surface may only partially and not entirely be in close contact with the second magnetic layer 12, while the insulating layer 15 may be interposed for the other portion.

What is claimed is:

1. An inductor component comprising:

a magnetic layer containing a magnetic powder and a resin containing the magnetic powder;

a first spiral wiring and a second spiral wiring disposed on the same plane in the magnetic layer and adjacent to each other; and an insulating layer disposed between the first spiral wiring and the second spiral wiring and containing no magnetic substance, wherein the first spiral wiring includes a first side surface facing the second spiral wiring, at least a portion of the first side surface is in contact with the magnetic layer the insulating layer is in contact with a portion of the first side surface, and a second side surface on the side opposite to the first side surface of the first spiral wiring is in contact with the magnetic layer.

2. The inductor component according to claim 1, wherein the insulating layer is disposed at a position including a region in which a distance is minimum between the first spiral wiring and the second spiral wiring.

3. The inductor component according to claim 1, wherein the magnetic layer is interposed between the insulating layer and the first side surface.

4. The inductor component according to claim 1, wherein the thickness of the insulating layer is larger than the thickness of the first spiral wiring.

5. The inductor component according to claim 1, further comprising a plurality of external terminals arranged on a surface of the magnetic layer, a first columnar wiring connecting the first spiral wiring and one of the plurality of external terminals and penetrating the magnetic layer, and a second columnar wiring connecting the second spiral wiring and one of the plurality of external terminals and penetrating the magnetic layer, wherein the insulating layer is disposed also between the first columnar wiring and the second columnar wiring.

6. The inductor component according to claim 1, further comprising a third spiral wiring disposed above the first spiral wiring, wherein the first spiral wiring and the third spiral wiring are electrically connected.

7. The inductor component according to claim 6, further comprising an interlayer insulating layer disposed between the first spiral wiring and the third spiral wiring, wherein the thickness of the interlayer insulating layer is smaller than the width of the insulating layer.

8. The inductor component according to claim 1, wherein the magnetic powder contains Fe-based magnetic powder.

9. The inductor component according to claim 8, wherein the Fe-based magnetic powder is FeSiCr and has an average particle diameter of 5 μm or less.

10. The inductor component according to claim 1, wherein the resin contains at least one of an epoxy resin and an acrylic resin.

11. The inductor component according to claim 1, wherein the magnetic powder contains ferrite powder.

12. The inductor component according to claim 1, wherein the insulating layer contains at least one of an epoxy resin, a polyimide resin, a phenol resin, and a vinyl ether resin.

13. The inductor component according to claim 1, wherein the first spiral wiring has an exposed portion exposed to the outside from a side surface parallel to a lamination direction of the inductor component.

14. The inductor component according to claim 13, wherein a thickness of an exposed surface of the exposed portion is equal to or less than the thickness of the first spiral wiring and is 45 μm or more.

15. The inductor component according to claim 14, wherein the exposed surface is an oxide film.

16. The inductor component according to claim 2, wherein the magnetic layer is interposed between the insulating layer and the first side surface.

17. The inductor component according to claim 2, wherein the thickness of the insulating layer is larger than the thickness of the first spiral wiring.

18. The inductor component according to claim 2, further comprising a plurality of external terminals arranged on a surface of the magnetic layer, a first columnar wiring connecting the first spiral wiring and one of the plurality of external terminals and penetrating the magnetic layer, and a second columnar wiring connecting the second spiral wiring and one of the plurality of external terminals and penetrating the magnetic layer, wherein the insulating layer is disposed also between the first columnar wiring and the second columnar wiring.

19. An inductor component comprising:

a magnetic layer containing a magnetic powder and a resin containing the magnetic powder;

a first spiral wiring and a second spiral wiring disposed on the same plane in the magnetic layer and adjacent to each other; and an insulating layer disposed between the first spiral wiring and the second spiral wiring and containing no magnetic substance, wherein the first spiral wiring includes a first side surface facing the second spiral wiring, at least a portion of the first side surface is in contact with the magnetic layer, and the first and second spiral wirings have a semi-elliptical arc shape when viewed in the Z direction.

* * * * *